US009488066B2

(12) United States Patent
Yamashita et al.

(10) Patent No.: US 9,488,066 B2
(45) Date of Patent: Nov. 8, 2016

(54) TURBINE VANE OF STEAM TURBINE AND STEAM TURBINE

(75) Inventors: Hiroyuki Yamashita, Minato-ku (JP); Hiroharu Oyama, Minato-ku (JP); Takashi Maruyama, Minato-ku (JP); Yuki Yamamoto, Minato-ku (JP); Shohei Danno, Minato-ku (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 782 days.

(21) Appl. No.: 13/989,842

(22) PCT Filed: Dec. 6, 2011

(86) PCT No.: PCT/JP2011/078139

§ 371 (c)(1),
(2), (4) Date: May 28, 2013

(87) PCT Pub. No.: WO2012/086400

PCT Pub. Date: Jun. 28, 2012

(65) Prior Publication Data

US 2013/0243587 A1 Sep. 19, 2013

(30) Foreign Application Priority Data

Dec. 22, 2010 (JP) ..... 2010-285756

(51) Int. Cl.
*F01D 25/00* (2006.01)
*F01D 5/16* (2006.01)
(Continued)

(52) U.S. Cl.
CPC ..... *F01D 25/00* (2013.01); *F01D 5/16* (2013.01); *F01D 25/06* (2013.01); *F01D 9/041* (2013.01); *F05D 2300/501* (2013.01)

(58) Field of Classification Search
CPC ..... F01D 25/00; F01D 25/04; F01D 25/06; F01D 5/16; F01D 5/18; F01D 5/188; F01D 5/26; F01D 9/041; F05D 2300/501; F05D 2220/31; F05D 2230/232; F05D 2240/126; F05D 2260/96; F04D 29/66; F04D 29/661; F04D 29/668
See application file for complete search history.

(56) References Cited

U.S. PATENT DOCUMENTS 2,642,263 A 1/1951 Thorp, II
2,600,048 A * 6/1952 Conwell ..... B64C 11/24 29/889.72

(Continued)

FOREIGN PATENT DOCUMENTS

CN 101333943 12/2008
GB 778685 7/1957

(Continued)

OTHER PUBLICATIONS

Kazuishi, JP2009-264219 (English Machine Translation), trnaslated by ProQuestDocuments—Mar. 29, 2016 (1).*

(Continued)

*Primary Examiner* — Ninh H Nguyen
*Assistant Examiner* — Wayne A Lambert
(74) *Attorney, Agent, or Firm* — Wenderoth, Lind & Ponack, L.L.P.

(57) ABSTRACT

Vane members have a space formed therein and a plate spring member is disposed inside the space of the vane members and elastically contacts inner surfaces of the vane members. The plate spring member includes a positioning portion, an elastic contact portion, and a connection portion. The elastic contact portion is divided into a plurality of segments in a length direction of the vane members. The elastic contact portion elastically contacts the inner surfaces of the vane members without any partial contact throughout an entire surface thereof. The elastic contact area between the elastic contact portion and the inner surfaces of the vane members is widened.

6 Claims, 14 Drawing Sheets

(51) Int. Cl.
*F01D 25/06* (2006.01)
*F01D 9/04* (2006.01)

(56) References Cited

U.S. PATENT DOCUMENTS

| | | | | | |
|---|---|---|---|---|---|
| 2,689,107 | A * | 9/1954 | Odegaard | F01D 5/16 | 416/229 R |
| 2,801,073 | A * | 7/1957 | Savage | F01D 5/188 | 416/219 R |
| 2,873,944 | A * | 2/1959 | Wiese | F01D 5/189 | 416/92 |
| 2,906,495 | A * | 9/1959 | Schum | F01D 5/188 | 416/219 R |
| 2,914,300 | A * | 11/1959 | Sayre | F01D 9/042 | 415/135 |
| 2,920,866 | A * | 1/1960 | Spurrier | F01D 5/18 | 416/233 |
| 2,921,769 | A * | 1/1960 | Flader | F01D 5/147 | 416/222 |
| 2,925,996 | A * | 2/1960 | Stalker | F01D 5/16 | 416/233 |
| 3,095,180 | A | 6/1963 | Clarke et al. | | |
| 3,606,580 | A * | 9/1971 | Kaufman, Sr. | B21H 7/16 | 416/232 |
| 4,519,745 | A * | 5/1985 | Rosman | F01D 5/284 | 416/241 B |
| 5,056,738 | A * | 10/1991 | Mercer | F01D 5/16 | 244/54 |
| 5,356,264 | A * | 10/1994 | Watson | F01D 25/04 | 415/119 |
| 5,407,321 | A * | 4/1995 | Rimkunas | F01D 5/16 | 415/115 |
| 5,498,137 | A * | 3/1996 | El-Aini | F01D 5/16 | 416/144 |
| 5,509,783 | A | 4/1996 | Jones | | |
| 5,681,142 | A * | 10/1997 | Lewis | F01D 9/042 | 415/119 |
| 6,524,074 | B2 * | 2/2003 | Farrar | F01D 5/28 | 416/229 A |
| 6,994,524 | B2 * | 2/2006 | Owen | B23P 15/04 | 416/233 |
| 7,025,568 | B2 * | 4/2006 | Jones | F01D 5/16 | 29/889.72 |
| 7,128,536 | B2 * | 10/2006 | Williams | F01D 5/16 | 416/229 R |
| 7,955,054 | B2 * | 6/2011 | El-Aini | F01D 5/16 | 416/146 R |
| 2009/0304517 | A1 * | 12/2009 | Strother | F01D 5/147 | 416/223 A |
| 2010/0329847 | A1 | 12/2010 | Yamashita et al. | | |
| 2012/0034091 | A1 * | 2/2012 | Goldfinch | F01D 5/147 | 416/227 R |

FOREIGN PATENT DOCUMENTS

| | | |
|---|---|---|
| GB | 2 154 286 | 9/1985 |
| JP | 60-198304 | 10/1985 |
| JP | 5-14503 | 2/1993 |
| JP | 9-209708 | 8/1997 |
| JP | 11-336503 | 12/1999 |
| JP | 2005-220902 | 8/2005 |
| JP | 2005-337237 | 12/2005 |
| JP | 3747387 | 2/2006 |
| JP | 2008-133825 | 6/2008 |
| JP | 2009-264219 | 11/2009 |
| JP | 2010-285756 | 12/2010 |
| JP | 5660883 | 1/2015 |

OTHER PUBLICATIONS

Chinese Office Action issued Jul. 31, 2014 in corresponding Chinese Patent Application No. 201180057580.2 with English translation.

Japanese Decision of a Patent Grant issued Nov. 4, 2014 in corresponding Japanese Patent Application No. 2010-285756 with English translation.

Korean Notice of Allowance issued Jan. 12, 2015 in corresponding Korean Patent Application No. 10-2013-7013802 with partial English translation.

Chinese Notification on the Grant of Patent for Invention issued Feb. 5, 2015 in corresponding Chinese Patent Application No. 201180057580.2 with English translation.

Written Opinion of the International Searching Authority mailed Mar. 13, 2012 in International (PCT) Application No. PCT/JP2011/078139.

International Search Report issued Mar. 13, 2012 in International (PCT) Application No. PCT/JP2011/078139.

Japanese Office Action issued May 19, 2015 in corresponding Japanese Patent Application No. 2014-184661 with English Translation.

Japanese Notice of Allowance issued Aug. 4, 2015 in corresponding Japanese Patent Application No. 2014-184661 with English Translation.

* cited by examiner

TURBINE VANE OF STEAM TURBINE AND STEAM TURBINE

FIELD

The present invention relates to a turbine vane with an inner space of a steam turbine. Further, the invention relates to a steam turbine that includes a turbine vane with an inner space.

BACKGROUND

In order to realize a decrease in the weight of a turbine vane of a steam turbine and a steam turbine, there is known a technique of a hollow structure in which a space is formed inside the turbine vane. Further, in order to realize improvement in the performance of the turbine vane of the steam turbine and the steam turbine, there is proposed a technique in which the turbine vane is provided with slits for causing the inner space of the turbine vane to communicate with the outside and water (steam and water droplet) adhering to the surface of the turbine vane is brought into the inner space of the turbine vane so as to be removed therefrom (for example, see Japanese Patent Publication No. 11-336503).

In the turbine vane of the hollow structure, there is a case in which self-excited vibration (flutter) is generated in response to the outer shape (geometrical shape) or the mass of the turbine vane and the circumferential environment of the turbine vane during the operation of the turbine (for example, the flow velocity or the mass of the steam passing through the turbine vane). The self-excited vibration is easily generated when the mass of the turbine vane is small and the vane width (the entire length of the vane) is long. Particularly, in order to obtain the high efficiency of the turbine in recent years, there is a tendency that the mass of the turbine vane is decreased and the vane width is lengthened. For this reason, there is a tendency that the self-excited vibration is more easily generated.

Therefore, in the turbine vane of the hollow structure, a technique capable of suppressing the self-excited vibration is proposed (for example, see Japanese Patent Publication No. 2008-133825). In this technique, a slidable contact member (plate spring member) capable of slidably contacting (elastically contacting) the vane inner surface (the inner surface of the vane member) from the hollow space (the inner space) is provided. In this technique, when the turbine vane is elastically deformed, the slidable contact member slidably contacts the vane inner surface from the hollow space. Accordingly, friction is generated between the vane inner surface and the slidable contact member, and the elastic deformation of the turbine vane is reduced by the friction, so that the self-excited vibration generated in the turbine vane is suppressed.

Here, the self-excited vibration generated in the turbine vane may be reliably suppressed as the area in which the slidable contact member slidably contacts the vane inner surface is widened. Incidentally, there is a case in which the slidable contact member partially contacts the vane inner surface due to the manufacturing tolerances (manufacturing variation) of the turbine vane and the slidable contact member, so that a slidable contact area according to a design (a plan and a calculation) may not be obtained.

In this way, in the turbine vane of the steam turbine and the steam turbine, it is important to devise a structure capable of reliably suppressing the self-excited vibration generated in the turbine vane in a manner such that the manufacturing tolerances of the turbine vane and the slidable contact member are absorbed so that the slidable contact member slidably contacts the vane inner surface according to the design and the slidable contact area is obtained according to the design.

SUMMARY

Technical Problem

It is an object of the invention to reliably suppress self-excited vibration generated in a turbine vane in a turbine vane of a steam turbine and a steam turbine.

Solution to Problem

According to an aspect of the present invention, a turbine vane of a steam turbine includes: a vane member that has a space formed therein; and a plate spring member that is disposed inside the space of the vane member and elastically contacts an inner surface of the vane member. The plate spring member includes a positioning portion which is positioned in the inner surface of the vane member, an elastic contact portion which elastically contacts the inner surface of the vane member, and a connection portion which connects the positioning portion to the elastic contact portion, and the elastic contact portion is divided into plural numbers in the length direction of the vane member.

Advantageously, in the turbine vane of the steam turbine, the plate spring member is formed as one piece.

Advantageously, in the turbine vane of the steam turbine, the plate spring member is divided into plural pieces in the length direction of the vane member.

Advantageously, in the turbine vane of the steam turbine, the elastic contact portion of the plate spring member is an area in which the elastic contact portion elastically contacts the inner surface of the vane member, and the elastic contact area of the elastic contact portion at the center in the length direction of the vane member is wider than the elastic contact area of the elastic contact portion at both ends in the length direction of the vane member.

Advantageously, in the turbine vane of the steam turbine, the elastic contact portion of the plate spring member elastically contacts an inner surface of a back surface of the vane member.

Advantageously, in the turbine vane of the steam turbine, a structure for positioning the inner surface of the vane member and the positioning portion of the plate spring member is formed as an uneven fitting positioning structure.

According to another aspect of the present invention, a steam turbine comprising a plurality of the turbine vanes of the steam turbine according to any one of the above arranged in the circumferential direction of a rotor shaft.

Advantageous Effects of Invention

In the turbine vane of the steam turbine of the invention (a first aspect of the present invention), the elastic contact portion of the plate spring member is divided into plural numbers in the length direction of the vane member, so that the manufacturing tolerances of the vane member and the plate spring member may be absorbed. Accordingly, in the turbine vane of the steam turbine of the invention (the first aspect of the present invention), the elastic contact portion of the plate spring member divided into plural numbers in the length direction of the vane member may elastically contact the inner surface of the vane member without any partial contact, according to the design. As a result, in the turbine vane of the steam turbine of the invention (the first aspect of the present invention), the elastic contact area according to the design may be obtained, so that the self-excited vibration generated in the turbine vane may be reliably suppressed.

In addition, in the turbine vane of the steam turbine of the invention (the first aspect of the present invention), the elastic contact portion of the plate spring member does not partially contact the inner surface of the vane member, so that the spring reaction force of the elastic contact portion of the plate spring member is obtained according to the design. As a result, in the turbine vane of the steam turbine of the invention (the first aspect of the present invention), the keeping-down operation may be easily performed in the assembly of the vane member and the plate spring member.

Furthermore, in the turbine vane of the steam turbine of the invention (the first aspect of the present invention), the elastic contact portion of the plate spring member does not partially contact the inner surface of the vane member, so that the spring reaction force of the elastic contact portion of the plate spring member is obtained according to the design. As a result, in the turbine vane of the steam turbine of the invention (a first aspect of the present invention), the surface of the vane member is not deformed by the partial contact caused when assembling the vane member and the plate spring member.

In the turbine vane of the steam turbine of the invention (a second aspect of the present invention), the plate spring member is formed as one piece, so that the assembling operation of the vane member and the plate spring member may be easily performed without increasing the number of components.

In the turbine vane of the steam turbine of the invention (a third aspect of the present invention), the plate spring member is divided into plural pieces in the length direction of the vane member. Accordingly, compared to the plate spring member formed as one piece, the degree of freedom increases, and hence the absorbency (followability) with respect to the manufacturing tolerance (manufacturing variation) or the shape of the vane member is improved. Further, the elastic contact area according to the design may be easily and reliably ensured.

In the turbine vane of the steam turbine of the invention (a fourth aspect of the present invention), the elastic contact area at the center in the length direction of the vane member is wider than the elastic contact area at both ends in the length direction of the vane member, so that the self-excited vibration may be effectively suppressed.

In the turbine vane of the steam turbine of the invention (a fifth aspect of the present invention), the elastic contact portion of the plate spring member elastically contacts the inner surface of the back surface wider than the inner surface of the face surface of the vane member, so that the elastic contact area between the elastic contact portion of the plate spring member and the inner surface of the back surface of the vane member may be widened. As a result, in the turbine vane of the steam turbine of the invention (the fifth aspect of the present invention), the self-excited vibration generated in the turbine vane may be further reliably suppressed.

In the turbine vane of the steam turbine of the invention (a sixth aspect of the present invention), the inner surface of the vane member and the positioning portion of the plate spring member are positioned by the uneven fitting positioning structure, so that the welding operation may not be provided compared to the case where the inner surface of the vane member and the positioning portion of the plate spring member are positioned by the welding portion. As a result, in the turbine vane of the steam turbine of the invention (the sixth aspect of the present invention), the welding operation is not provided, so that the assembling process of the vane member and the plate spring member may be shortened, and the manufacturing cost may be decreased.

Furthermore, in the turbine vane of the steam turbine of the invention (the sixth aspect of the present invention), the welding operation is not performed, so that the welding strain is not generated. Accordingly, the elastic contact area between the elastic contact portion of the plate spring member and the inner surface of the vane member may be widened, so that the self-excited vibration generated in the turbine vane may be further reliably suppressed. In addition, in the turbine vane of the steam turbine of the invention (the sixth aspect of the present invention), the welding operation is not performed, so that the assembling process may be shortened and the manufacturing cost may be decreased.

In the steam turbine of the invention (a seventh aspect of the present invention), the turbine vane of the steam turbine according to any one of first to sixth aspects of the present invention is used, so that the same effect as that of the turbine vane of the steam turbine according to any one of first to sixth aspects of the present invention may be obtained. That is, the self-excited vibration generated in the turbine vane may be reliably suppressed.

DESCRIPTION OF EMBODIMENTS

Figure 1:
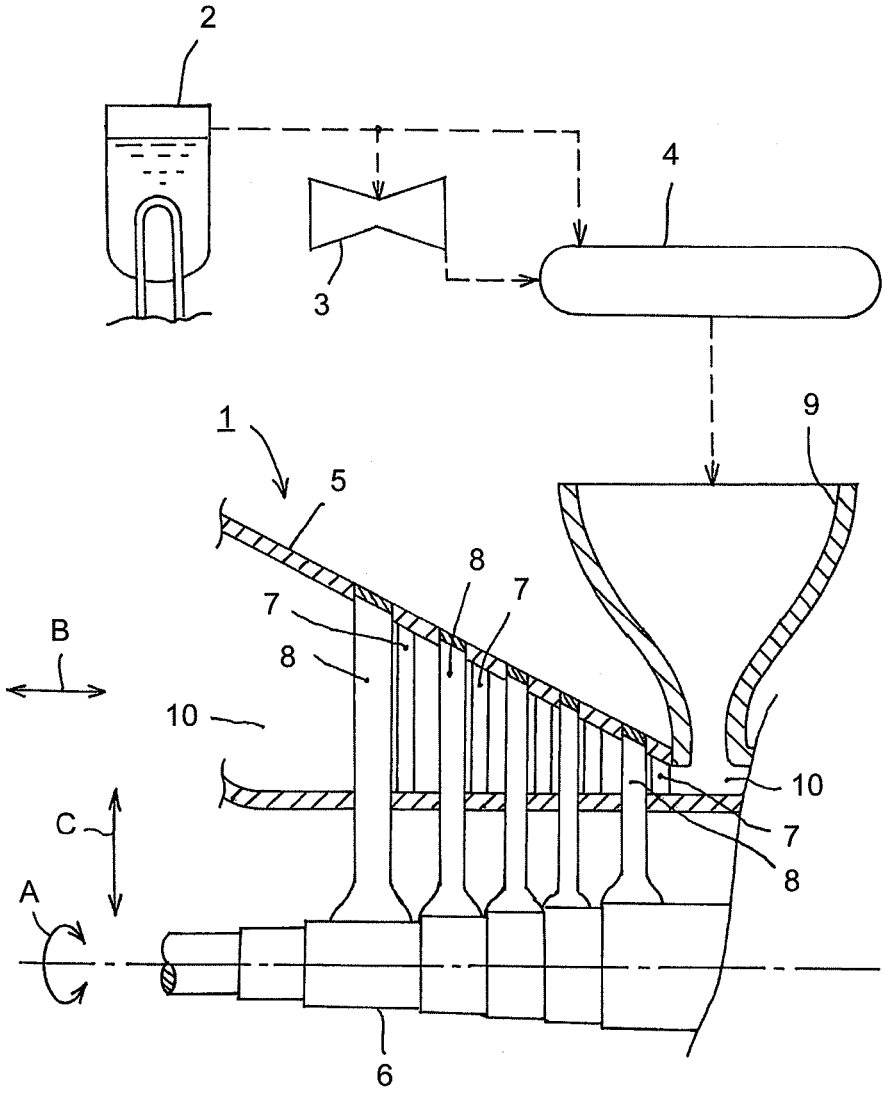
FIG. 1 is a schematic diagram illustrating a schematic configuration representing First Embodiment of a steam turbine according to the invention.

Hereinafter, six embodiments of a turbine vane of a steam turbine according to the invention and an embodiment of a steam turbine according to the invention will be described in detail by referring to the drawings. Furthermore, the invention is not limited to the embodiments.

First Embodiment

Figure 2:
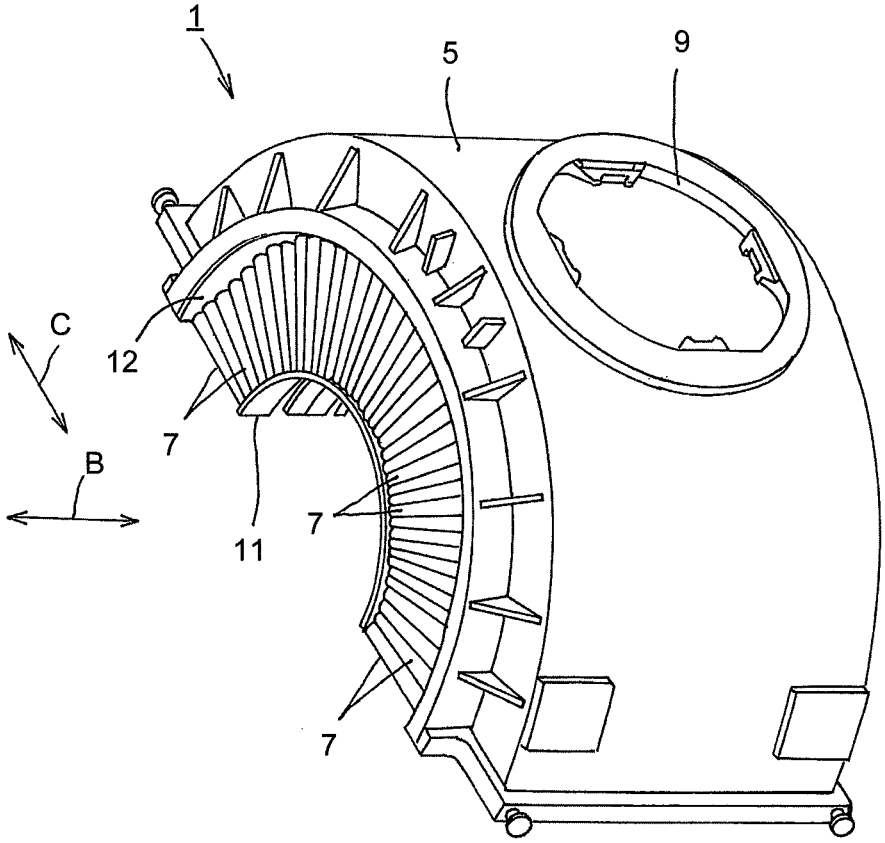
FIG. 2 is a partially perspective view illustrating a nozzle box of the steam turbine when viewed in a low-pressure final stage.
Figure 3:
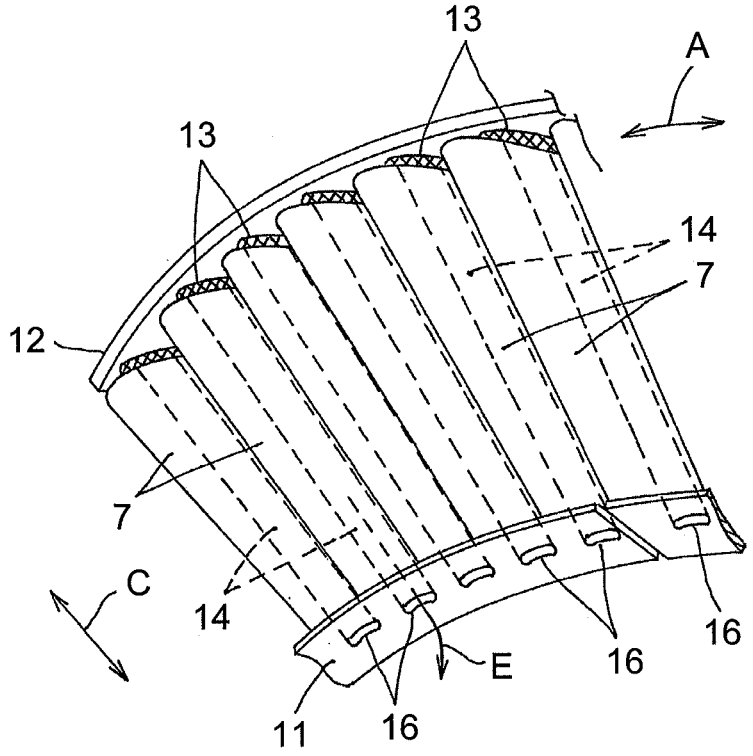
FIG. 3 is a partially perspective view illustrating a diaphragm of a turbine vane of the steam turbine when viewed in the low-pressure final stage.
Figure 4:
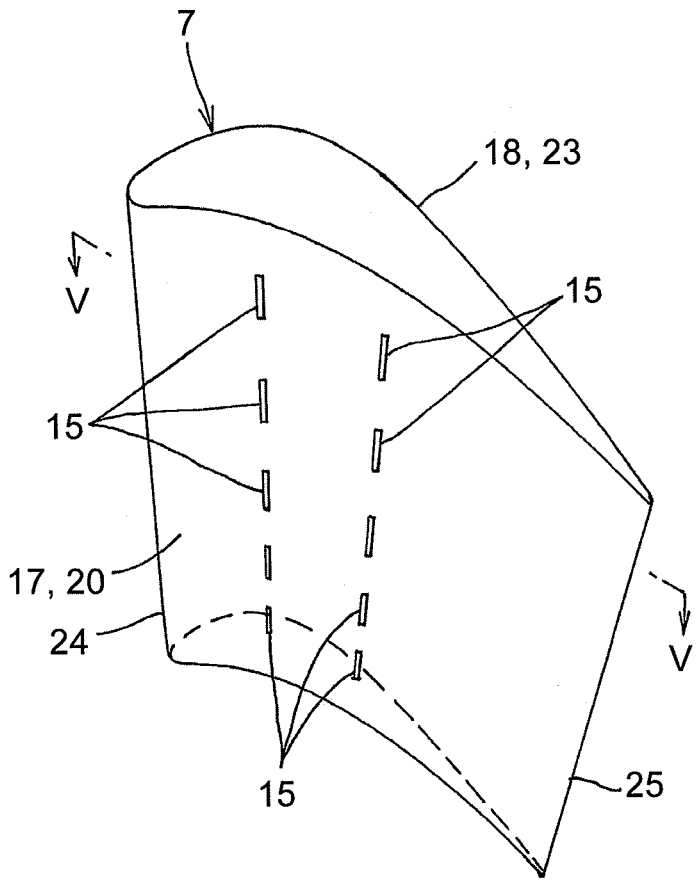
FIG. 4 is a perspective view illustrating First Embodiment of the turbine vane of the steam turbine according to the invention.

FIGS. 1 to 3 illustrate First Embodiment of the steam turbine according to the invention. FIGS. 4 to 9 illustrate First Embodiment of the turbine vane of the steam turbine according to the invention. Hereinafter, the steam turbine of First Embodiment and the turbine vane of the steam turbine of First Embodiment will be respectively described.

"Description of Steam Turbine 1"

In FIG. 1, the reference sign 1 indicates the steam turbine of First Embodiment. The steam turbine 1 is used in, for example, a nuclear power plant. The nuclear power plant includes a steam generator 2 which generates high-pressure steam, a high-pressure steam turbine 3 to which the high-pressure steam is directly supplied from the steam generator 2, a moisture separator heater 4 which separates and heats moisture of the steam from the steam generator 2 and the high-pressure steam turbine 3, and the steam turbine (low-pressure steam turbine) 1 to which the low-pressure steam is supplied from the moisture separator heater 4.

The steam turbine 1 includes a casing (a turbine casing and a turbine wheel chamber) 5, a rotor shaft (turbine shaft) 6 which is rotatably attached to the casing 5, a plurality of (multiple) turbine vanes 7 which are arranged in the casing 5 in the circumferential direction A of the rotor shaft 6, and a plurality of (multiple) turbine blades 8 which are arranged in the rotor shaft 6 in the circumferential direction A of the rotor shaft 6.

The casing 5 is provided with a steam inlet 9. Further, the casing 5 includes therein a steam passage 10 which is provided in the axial direction B of the rotor shaft 6 so as to communicate with the steam inlet 9.

The group of the plurality of turbine vanes 7 arranged in an annular shape on the base side (the side of the rotor shaft 6, the inner side, and the inner side of the rotor shaft 6 in the radial direction C) is connected to a shroud (an inner race and an inner ring) 11 by welding portions (not illustrated). Further, the group of the plurality of turbine vanes 7 arranged in an annular shape on the tip side (the side of the casing 5, the outer side, and the outer side of the rotor shaft 6 in the radial direction C) is connected to a blade root ring (an outer race and an outer ring) 12 by welding portions 13. The blade root ring 12 is fixed to the casing 5. The turbine vane 7 has therein a space 14. A face surface 20 (see FIGS. 4, 5, and 7) of the turbine vane 7 is provided with slits 15 (see FIGS. 4 and 5) which communicate with the space 14. The shroud 11 is provided with openings 16 (see FIG. 3) which communicate with the space 14.

The group of the plurality of turbine blades 8 arranged in an annular shape on the base side is fixed to the rotor shaft 6. The group of the plurality of turbine blades 8 arranged in an annular shape on the tip side faces the casing 5.

As in the group of the plurality of turbine vanes 7 arranged in an annular shape, the group of the plurality of turbine blades 8 arranged in an annular shape forms one stage by a pair. In the steam turbine 1, the group of the turbine vanes 7 and the group of the turbine blades 8 are provided with a plurality of stages. The vane widths of the turbine vane 7 and the turbine blade 8 (the length of the vane in the radial direction C of the rotor shaft 6, that is, the direction substantially perpendicular to the axial direction B of the rotor shaft 6) are formed so as to be longer as it goes from the upstream side of the steam passage 10 toward the downstream side thereof. The stage positioned at the most downstream side of the steam passage 10 is referred to as a low-pressure final stage. The vane widths of the turbine vane 7 and the turbine blade 8 at the low-pressure final stage are the longest among the vane widths of the turbine vanes 7 and the turbine blades 8 at the other stages.

Hereinafter, an operation of the steam turbine 1 with the above-described configuration will be described. The steam which is supplied from the moisture separator heater 4 to the steam inlet 9 flows through the steam passage 10 in the axial direction B of the rotor shaft 6. At this time, kinetic energy is generated by the dropped pressure in the group of the turbine vanes 7, and the kinetic energy is converted into a rotational torque by the group of the turbine blades 8. As a result, the rotor shaft 6 is rotationally driven to generate power.

Figure 5:
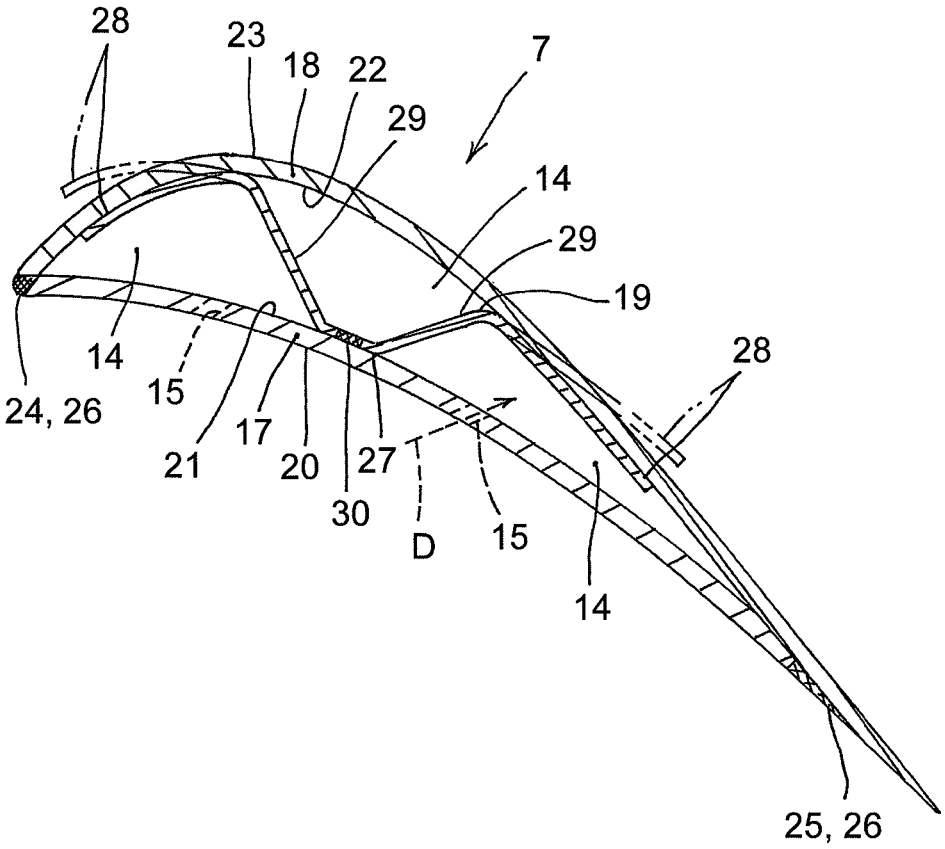
FIG. 5 is a cross-sectional view taken along the line V-V of FIG. 4.

Water (steam and water droplet) adhering to the face surface 20 (surface) of the turbine vane 7 moves on the face surface 20 in a direction indicated by the dashed arrow D of FIG. 5 due to the steam pressure applied thereto, and flows from the slit 15 into the space 14. The water which flows into the space 14 flows toward the shroud 11 in the radial direction C of the rotor shaft 6, and flows outward (to be discharged) from the opening 16 in a direction indicated by the solid arrow E of FIG. 3.

"Description of Configuration of Turbine Vane 7"

Hereinafter, a configuration of the turbine vane 7 of the steam turbine 1 of First Embodiment will be described. The turbine vane 7 includes a face side member 17 (see FIG. 7(A)), a back side member 18 (see FIG. 7(B)), and a plate spring member 19 (see FIG. 6).

Figure 6:
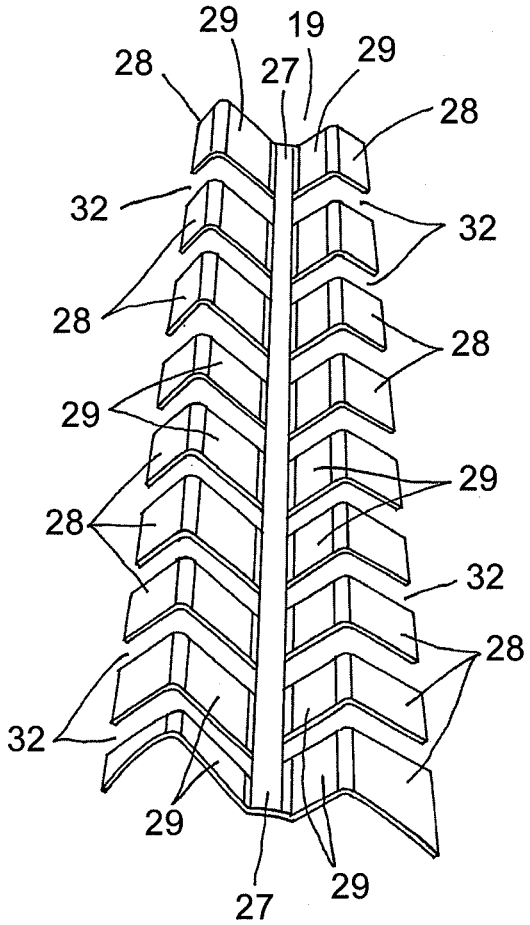
FIG. 6 is a perspective view illustrating a plate spring member when viewed in a base from a tip.
Figure 7:
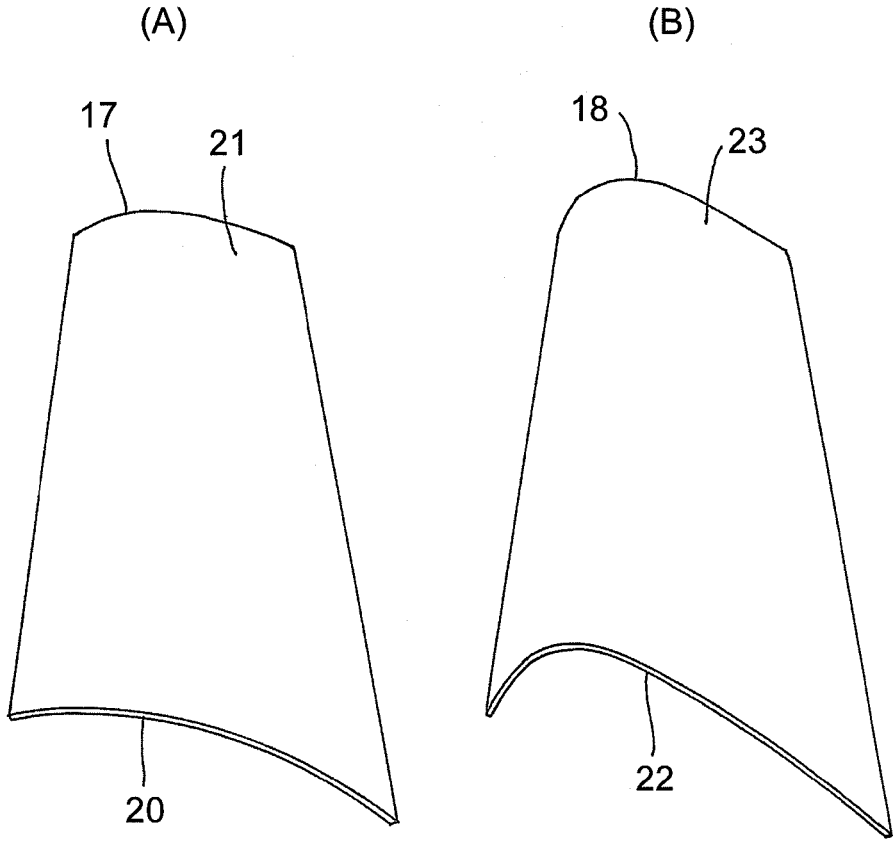
FIG. 7 is a perspective view illustrating a face side member and a back side member when viewed in the base from the tip.

As illustrated in the profile of FIG. 7(A), the face side member 17 is formed by pressing a sheet metal. The face side member 17 is provided with the slits 15. As illustrated in the profile of FIG. 7(B), the back side member 18 is formed by pressing a sheet metal. As illustrated in FIG. 6, the plate spring member 19 is formed by pressing a sheet metal (spring steel). The face side member 17, the back side member 18, and the plate spring member 19 form a three-dimensional curved surface.

As illustrated in FIG. 5, in the cross-sectional shape of the rotor shaft 6 in the axial direction B, the face side member 17 is curved so as to protrude from the face surface 20 as the outer surface toward the inner surface 21. The back side member 18 is curved so as to protrude from the inner surface 22 toward the back surface 23 as the outer surface. The curvature (warpage) of the face side member 17 and the curvature (warpage) of the back side member 18 are different from each other. As a result, the leading edge 24 of the face side member 17 is fixed to the leading edge 24 of the back side member 18 by a welding portion 26 and the trailing edge 25 of the face side member 17 is fixed to the trailing edge 25 of the back side member 18 by a welding portion 26. Then, a vane member which includes the face side member 17 and the back side member 18 has therein the space 14.

The plate spring member 19 includes a positioning portion 27, an elastic contact portion 28, and a connection portion 29. The plate spring member 19 is formed as one piece in this example. The positioning portion 27 is provided at the center of the plate spring member 19 in the length direction (the radial direction C of the rotor shaft 6) of the vane members 17 and 18 (the face side member 17 and the back side member 18). The elastic contact portion 28 is provided at both right and left side portions of the plate spring member 19 in the length direction of the vane members 17 and 18. The connection portion 29 is provided between the positioning portion 27 at the center and the elastic contact portion 28 at both right and left side portions, and connects the positioning portion 27 to the elastic contact portion 28. The elastic contact portions 28 and the connection portions 29 are provided as many as plural numbers, in this example, nine in the length direction of the vane members 17 and 18 by, for example, laser processing or the like so as to be approximately equally divided (that is, so that the contact areas between the elastic contact portion 28 and the inner surface 22 of the back side member 18 are approximately equal to each other). The widths of grooves 32 (the lengths of the vane members 17 and 18 in the length direction) that divide the elastic contact portion 28 and the connection portion 29 into plural numbers (nine) are approximately equal to each other.

Hereinafter, an assembling process of the turbine vane 7 that includes the face side member 17, the back side member 18, and the plate spring member 19 will be described.

Figure 8:
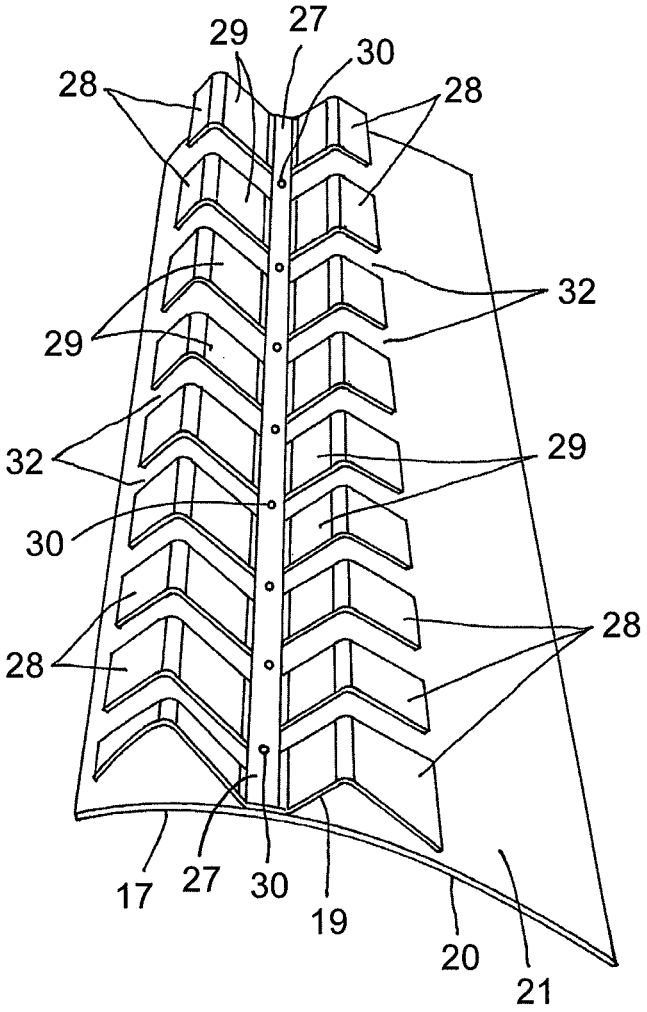
FIG. 8 is a perspective view illustrating a state where a plate spring member is positioned in the face side member when viewed in the base from the tip.

First, as illustrated in FIGS. 7(A), 7(B), and 6, the face side member 17, the back side member 18, and the plate spring member 19 are formed by pressing. Next, as illustrated in FIG. 8, the positioning portion 27 of the plate spring member 19 is placed on the inner surface 21 of the face side member 17. The inner surface 21 of the face side member 17 and the positioning portion 27 of the plate spring member 19 are positioned by a welding portion (a spot-welding portion or a plug-welding portion) 30.

Then, the inner surface 22 of the back side member 18 is placed on the elastic contact portion 28 of the positioned plate spring member 19. At this time, since the elastic contact portion 28 which is not elastically deformed yet (see the two-dotted chain line of FIG. 5) is positioned near the back side member 18 compared to the elastic contact portion 28 which is elastically deformed (see the solid line of FIG. 5), the inner surface 22 of the back side member 18 abuts against both right and left front ends of the elastic contact portion 28 of the plate spring member 19.

Figure 9:
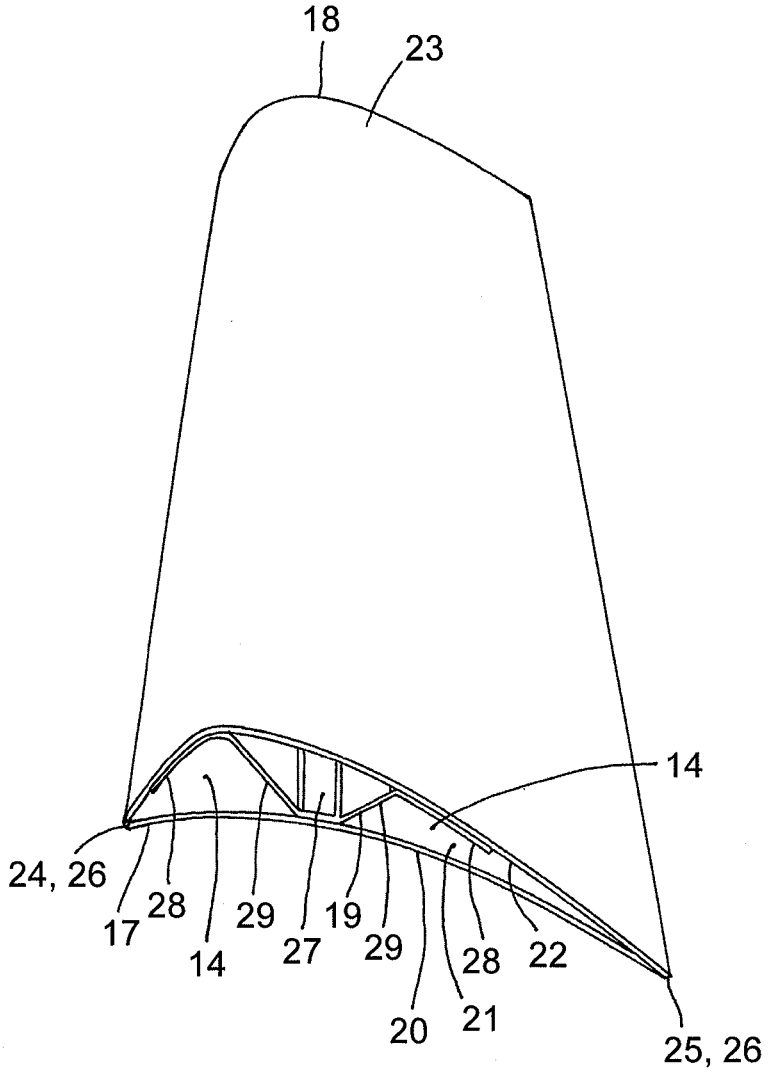
FIG. 9 is a perspective view illustrating a state where a back side member is fixed to the face side member and the plate spring member which are already positioned when viewed in the base from the tip.

Then, as illustrated in FIG. 9, the back side member 18 is pressed against the face side member 17, so that the elastic contact portion 28 of the plate spring member 19 is elastically deformed from the two-dotted chain line of FIG. 5 to the solid line of FIG. 5. At this time, since the inner surface 21 of the face side member 17 and the positioning portion 27 of the plate spring member 19 are positioned by the welding portion 30, the relative position between the face side member 17 and the plate spring member 19 is not deviated.

In this state, the leading edge 24 of the face side member 17 is fixed to the leading edge 24 of the back side member 18 by the welding portion 26 and the trailing edge 25 of the face side member 17 is fixed to the trailing edge 25 of the back side member 18 by the welding portion 26. As a result, as illustrated in FIG. 5, the plate spring member 19 is disposed inside the space 14 of the vane members 17 and 18. The elastic contact portion 28 elastically contacts the inner surfaces 21 and 22 of the vane members 17 and 18, that is, the inner surface 22 of the back side member 18 in this example.

"Description of Operation of Turbine Vane 7"

The turbine vane of the steam turbine of First Embodiment has the above-described configuration, and hereinafter, the operation thereof will be described.

During the operation of the steam turbine 1, the face side member 17 and the back side member 18 of the turbine vane 7 are elastically deformed. Then, friction is generated between the inner surface 22 of the back side member 18 and the elastic contact portion 28 of the plate spring member 19. By the friction, the elastic deformation of the face side member 17 and the back side member 18 of the turbine vane 7 is reduced. As a result, the self-excited vibration of the turbine vane 7 is suppressed.

"Description of Effect of Steam Turbine 1 and Effect of Turbine Vane 7"

The steam turbine 1 of First Embodiment and the turbine vane 7 of the steam turbine of First Embodiment have the above-described configuration and operation, and hereinafter, the effect thereof will be described.

In the steam turbine 1 of First Embodiment and the turbine vane 7 of the steam turbine of First Embodiment, the elastic contact portion 28 and the connection portion 29 of the plate spring member 19 are divided into plural numbers, that is, nine in this example in the length direction of the vane members 17 and 18, and hence the manufacturing tolerances of the vane members 17 and 18 and the plate spring member 19 may be absorbed. Accordingly, in the steam turbine 1 of First Embodiment and the turbine vane 7 of the steam turbine of First Embodiment, the elastic contact portion 28 of the plate spring member 19 divided into plural numbers, that is, nine in this example in the length direction of the vane members 17 and 18 may elastically contact the inner surfaces 21 and 22 of the vane members 17 and 18, that is, the inner surface 22 of the back side member 18 in this example without any partial contact, according to the design. As a result, the steam turbine 1 of First Embodiment and the turbine vane 7 of the steam turbine of First Embodiment may obtain the elastic contact area according to the design, and may reliably suppress the self-excited vibration generated in the turbine vane 7.

Here, in the steam turbine 1 of First Embodiment and the turbine vane 7 of the steam turbine of First Embodiment, the elastic contact portion 28 of the plate spring member 19 is divided into plural numbers (nine) by the grooves 32. For this reason, the area of the elastic contact portion 28 is slightly decreased. However, since the elastic contact portion 28 divided into plural numbers (nine) elastically contacts the inner surface 22 of the back side member 18 throughout the entire surface thereof, the elastic contact area between the inner surface 22 of the back side member 18 and the elastic contact portion 28 divided into plural numbers (nine) is wider than the elastic contact area between the inner surface 22 of the back side member 18 and the elastic contact portion which is not divided as in the structure of the related art compared with the structure of the related art in which the elastic contact portion that is not divided partially and elastically contacts the inner surface 22 of the back side member 18.

In addition, in the steam turbine 1 of First Embodiment and the turbine vane 7 of the steam turbine of First Embodiment, the elastic contact portion 28 of the plate spring member 19 does not partially contact the inner surfaces 21 and 22 of the vane members 17 and 18, that is, the inner surface 22 of the back side member 18 in this example, and hence the spring reaction force of the elastic contact portion 28 of the plate spring member 19 is obtained according to the design. As a result, in the steam turbine 1 of First Embodiment and turbine vane 7 of the steam turbine of First Embodiment, the keeping-down operation may be easily performed in the assembly of the vane members 17 and 18 and the plate spring member 19.

In addition, in the steam turbine 1 of First Embodiment and the turbine vane 7 of the steam turbine of First Embodiment, the elastic contact portion 28 of the plate spring member 19 does not partially contact the inner surfaces 21 and 22 of the vane members 17 and 18, that is, the inner surface 22 of the back side member 18 in this example, and hence the spring reaction force of the elastic contact portion 28 of the plate spring member 19 is obtained according to the design. As a result, in the steam turbine 1 of First Embodiment and the turbine vane 7 of the steam turbine of First Embodiment, the surfaces of the vane members 17 and 18 are not deformed by the partial contact caused when assembling the vane members 17 and 18 and the plate spring member 19.

In the steam turbine 1 of First Embodiment and the turbine vane 7 of the steam turbine of First Embodiment, the plate spring member 19 is formed as one piece, and hence the assembling operation of the vane members 17 and 18 and the plate spring member 19 may be easily performed without increasing the number of components.

In the steam turbine 1 of First Embodiment and the turbine vane 7 of the steam turbine of First Embodiment, the elastic contact portion 28 of the plate spring member 19 elastically contacts the inner surface 22 of the back side member 18 wider than the inner surface 21 of the face side member 17, and hence the elastic contact area between the elastic contact portion 28 of the plate spring member 19 and the inner surface 22 of the back side member 18 may be widened. As a result, the steam turbine 1 of First Embodiment and the turbine vane 7 of the steam turbine of First Embodiment may further reliably suppress the self-excited vibration generated in the turbine vane 7.

Second Embodiment

Figure 10:
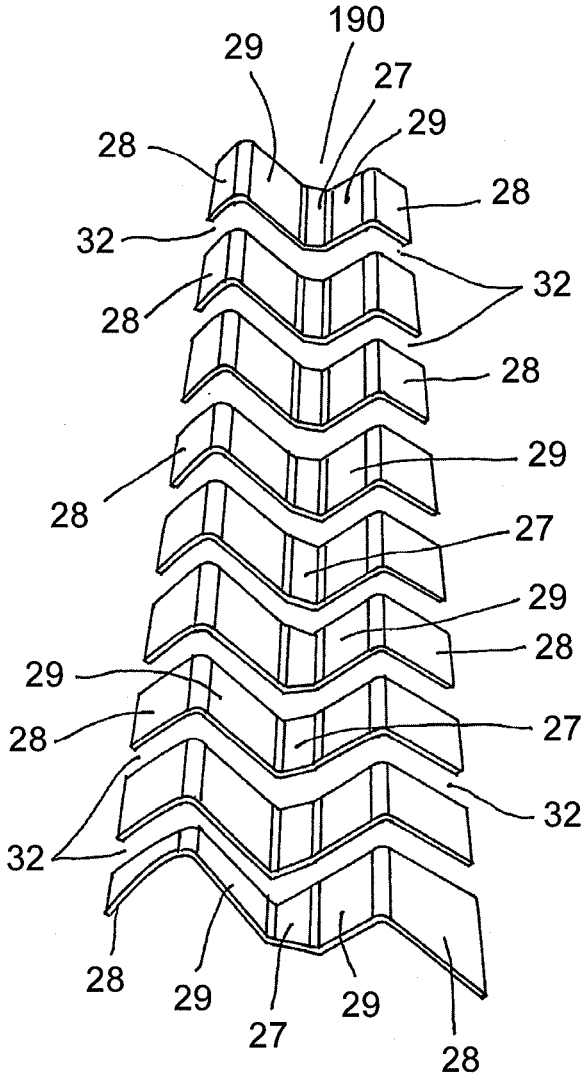
FIG. 10 is a perspective view illustrating Second Embodiment of a turbine vane of a steam turbine according to the invention when viewed in a base from a tip of a plate spring member.

FIG. 10 illustrates Second Embodiment of a turbine vane of a steam turbine according to the invention. Hereinafter, the turbine vane of the steam turbine of Second Embodiment will be described. In the drawings, the same reference signs of FIGS. 1 to 9 indicate the same components.

In the turbine vane 7 of the steam turbine of First Embodiment, the plate spring member 19 is formed as one piece. On the contrary, in the turbine vane 7 of the steam turbine of Second Embodiment, as illustrated in FIG. 10, a plate spring member 190 is approximately equally divided into plural numbers, that is, nine pieces in this example in the length direction of the vane members 17 and 18 (that is, so that the contact areas between the elastic contact portion 28 and the inner surface 22 of the back side member 18 are approximately equal to each other). That is, the positioning portion 27 is divided into plural numbers (nine) by the grooves 32 along with the elastic contact portion 28 and the connection portion 29 of the plate spring member 190.

Since the turbine vane 7 of the steam turbine of Second Embodiment has the above-described configuration, the substantially same operation and effect as those of the turbine vane 7 of the steam turbine of First Embodiment may be achieved.

Particularly, in the turbine vane 7 of the steam turbine of Second Embodiment, the plate spring member 190 is divided into plural numbers, that is, nine pieces in this example in the length direction of the vane members 17 and 18. Accordingly, the degree of freedom increases compared to the plate spring member 19 formed as one piece, and the absorbency (followability) with respect to the manufacturing tolerances (manufacturing variation) or the shapes of the vane members 17 and 18 is improved, so that the elastic contact area according to the design may be easily and reliably ensured.

Third Embodiment

Figure 11:
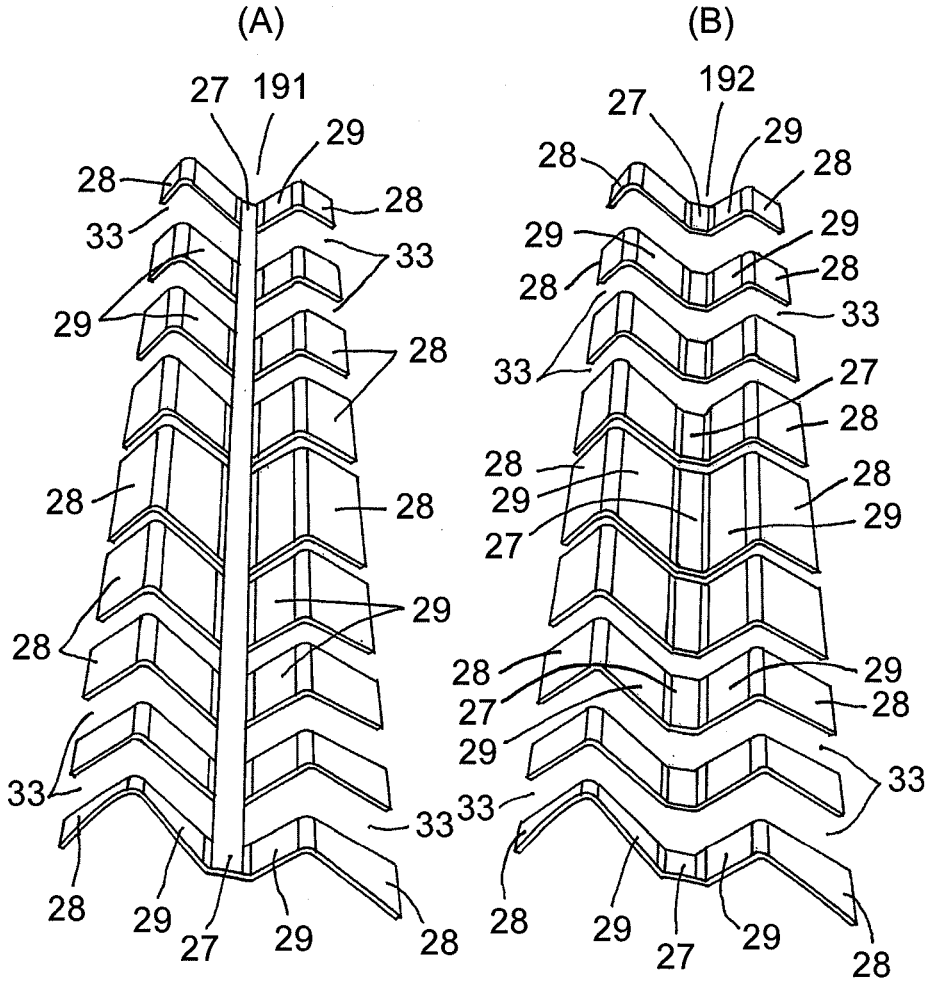
FIG. 11 is a perspective view illustrating Third Embodiment of a turbine vane of a steam turbine according to the invention when viewed in a base from a tip of a plate spring member.

FIGS. 11(A) and 11(B) illustrate Third Embodiment of a turbine vane of a steam turbine according to the invention. Hereinafter, the turbine vane of the steam turbine of Third Embodiment will be described. In the drawings, the same reference signs of FIGS. 1 to 10 indicate the same components.

In the turbine vane 7 of the steam turbine of First and Second Embodiments, the plate spring members 19 and 190 are divided into plural numbers (nine) by the grooves 32 substantially having the same width, and the contact areas between the elastic contact portion 28 of the plate spring members 19 and 190 divided into plural numbers (nine) and the inner surface 22 of the back side member 18 are substantially equal to each other (furthermore, the contact area of the tip-side elastic contact portion 28 is slightly different from the contact areas of the other elastic contact portions 28). On the contrary, in the turbine vane 7 of the steam turbine of Third Embodiment, as illustrated in FIGS. 11(A) and 11(B), the elastic contact area between the elastic contact portion 28 and the inner surface 22 of the back side member 18 at the center in the length direction of the vane members 17 and 18 is wider than the elastic contact area between the elastic contact portion 28 and the inner surface 22 of the back side member 18 at both end sides (the tip side and the base side) of the length direction of the vane members 17 and 18. In the width (the length in the length direction of the vane members 17 and 18) of a groove 33 that divides the elastic contact portion 28 and the connection portion 29 or the positioning portion 27, the elastic contact portion 28, and the connection portion 29 into plural numbers (nine), the width of the groove 33 at the center in the length direction of the vane members 17 and 18 is narrower than the width of the groove 33 at both ends in the length direction of the vane members 17 and 18. A plate spring member 191 illustrated in FIG. 11(A) is formed as one piece as in the turbine vane 7 of the steam turbine of First Embodiment. A plate spring member 192 illustrated in FIG. 11(B) is formed as plural numbers (nine) of pieces as in the turbine vane 7 of the steam turbine of Second Embodiment.

Since the turbine vane 7 of the steam turbine of Third Embodiment has the above-described configuration, the substantially same operation and effect as those of the turbine vane 7 of the steam turbine of First and Second Embodiments may be achieved.

Particularly, in the turbine vane 7 of the steam turbine of Third Embodiment, the elastic contact area between the elastic contact portion 28 and the inner surface 22 of the back side member 18 at the center in the length direction of the vane members 17 and 18 is wider than the elastic contact area between the elastic contact portion 28 and the inner surface 22 of the back side member 18 at both ends in the length direction of the vane members 17 and 18, and hence the self-excited vibration may be effectively suppressed.

Here, regarding the vibration mode (for example, the vibration mode assumed as the warpage mode while both ends are fixed) as the subject, it is valid (effective) to dispose the plate spring member at a position with large amplitude. For this reason, the self-excited vibration may be effectively suppressed by widening the elastic contact area at the center with large amplitude.

Fourth Embodiment

Figure 12:
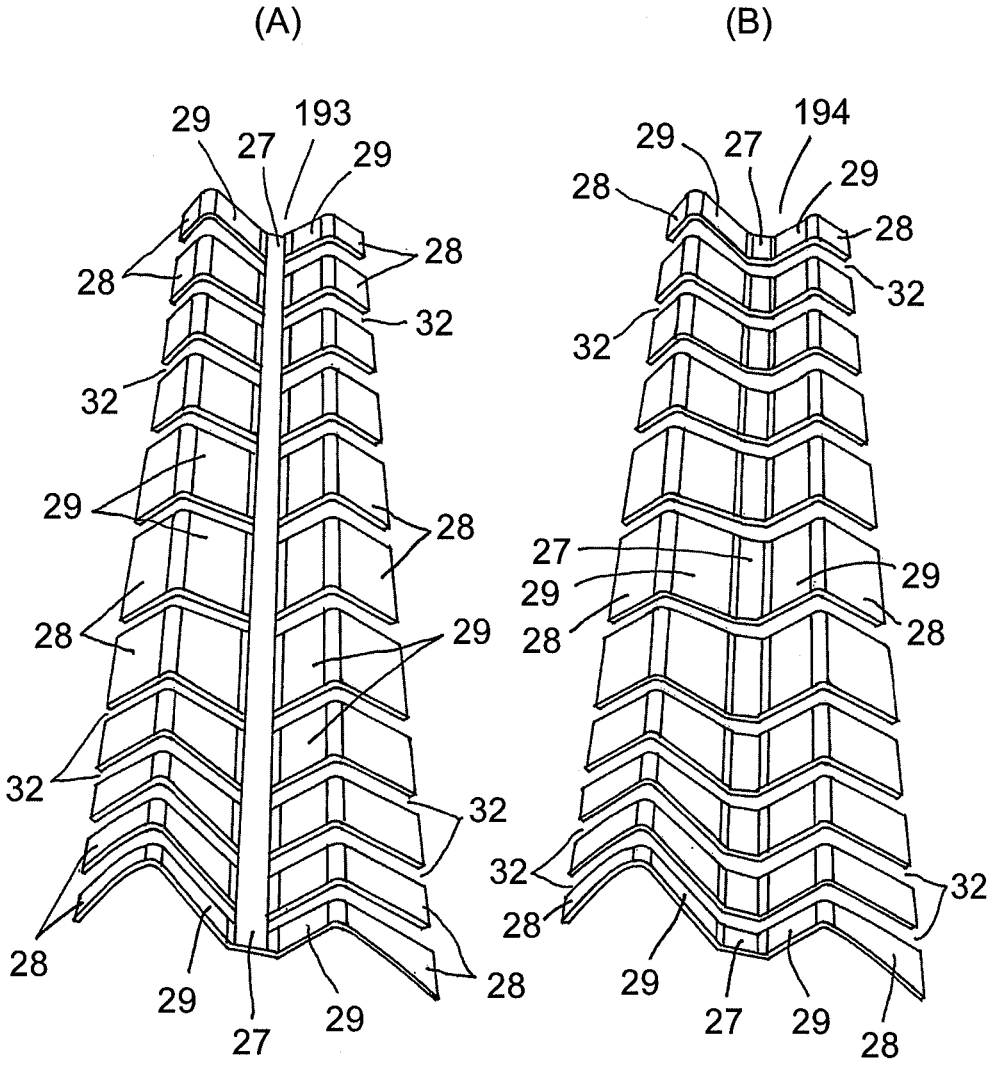
FIG. 12 is a perspective view illustrating Fourth Embodiment of a turbine vane of a steam turbine according to the invention when viewed in a base from a tip of a plate spring member.

FIGS. 12(A) and 12(B) illustrate Fourth Embodiment of a turbine vane of a steam turbine according to the invention. Hereinafter, the turbine vane of the steam turbine of Fourth Embodiment will be described. In the drawings, the same reference signs of FIGS. 1 to 11 indicate the same components.

In the turbine vane 7 of the steam turbine of Third Embodiment, the plate springs 191 and 192 are divided into plural numbers (nine) by the groove 33 of which the width of the groove 33 at the center in the length direction of the vane members 17 and 18 is narrower than the width of the groove 33 at both ends in the length direction of the vane members 17 and 18. Then, in the contact area between the inner surface 22 of the back side member 18 and the elastic contact portion 28 of the plate spring members 191 and 192 divided into plural numbers (nine), the elastic contact area between the inner surface 22 of the back side member 18 and the elastic contact portion 28 at the center in the length direction of the vane members 17 and 18 is wider than the elastic contact area between the inner surface 22 of the back side member 18 and the elastic contact portion 28 at both ends in the length direction of the vane members 17 and 18. On the contrary, in the turbine vane 7 of the steam turbine of Fourth Embodiment, as illustrated in FIGS. 12(A) and 12(B), the plate springs 193 and 194 are divided into plural numbers (nine) by the grooves 32 having substantially the same width. Then, in the contact area between the inner surface 22 of the back side member 18 and the elastic contact portion 28 of the plate spring members 193 and 194 divided into plural numbers (nine), the elastic contact area between the inner surface 22 of the back side member 18 and the elastic contact portion 28 at the center in the length direction of the vane members 17 and 18 is wider than the elastic contact area between the inner surface 22 of the back side member 18 and the elastic contact portion 28 at both ends in the length direction of the vane members 17 and 18. The plate spring member 193 illustrated in FIG. 12(A) is formed as one piece as in the turbine vane 7 of the steam turbine of First Embodiment and the turbine vane 7 of the steam turbine of Third Embodiment illustrated in FIG. 11(A). The plate spring member 194 illustrated in FIG. 12(B) is formed as plural numbers (nine) of pieces as in the turbine vane 7 of the steam turbine of Second Embodiment and the turbine vane 7 of the steam turbine of Third Embodiment illustrated in FIG. 11(B).

Since the turbine vane 7 of the steam turbine of Fourth Embodiment has the above-described configuration, the substantially same operation and effect as those of the turbine vane 7 of the steam turbine of First, Second, and Third Embodiments may be achieved.

Fifth Embodiment

Figure 13:
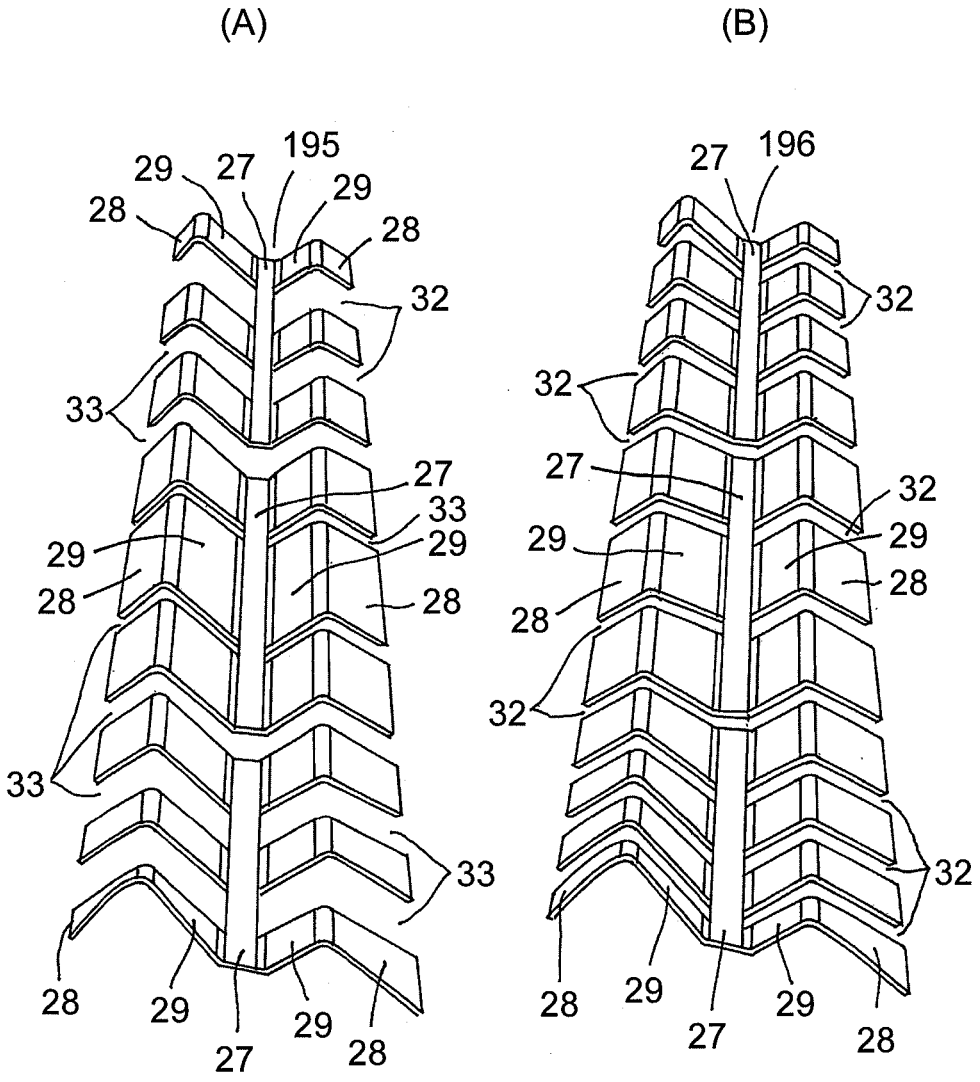
FIG. 13 is a perspective view illustrating Fifth Embodiment of a turbine vane of a steam turbine according to the invention when viewed in a base from a tip of a plate spring member.

FIGS. 13(A) and 13(B) illustrate Fifth Embodiment of a turbine vane of a steam turbine according to the invention. Hereinafter, the turbine vane of the steam turbine of Fifth Embodiment will be described. In the drawings, the same reference signs of FIGS. 1 to 12 indicate the same components.

In the turbine vane 7 of the steam turbine of First, Second, Third, and Fourth Embodiments, the elastic contact portion 28 and the connection portion 29 of the plate spring members 19, 191, and 193 formed as one piece are divided into plural numbers (nine), and the positioning portion 27, the elastic contact portion 28, and the connection portion 29 of the plate spring members 190, 192, and 194 are divided into plural numbers (nine) of pieces. On the contrary, in the turbine vane 7 of the steam turbine of Fifth Embodiment, as illustrated in FIG. 13(A), the plate spring 195 is divided into plural numbers (three) of pieces by the groove 33 of which the width of the groove 33 at the center in the length direction of the vane members 17 and 18 is narrower than the width of the groove 33 at both ends in the length direction of the vane members 17 and 18, and the elastic contact portion 28 and the connection portion 29 of the plate spring 195 formed as plural numbers (three) of pieces are respectively divided into plural numbers (three). Further, in the turbine vane 7 of the steam turbine of Fifth Embodiment, as illustrated in FIG. 13(B), the plate spring 196 is divided into plural numbers (three) of pieces by the grooves 32 having substantially the same width, and the elastic contact portion 28 and the connection portion 29 of the plate spring 196 formed as plural numbers (three) of pieces are respectively divided into plural numbers (three or four).

Since the turbine vane 7 of the steam turbine of Fifth Embodiment has the above-described configuration, the substantially same operation and effect as those of the turbine vane 7 of the steam turbine of First, Second, Third, and Fourth Embodiments may be achieved.

Sixth Embodiment

Figure 14:
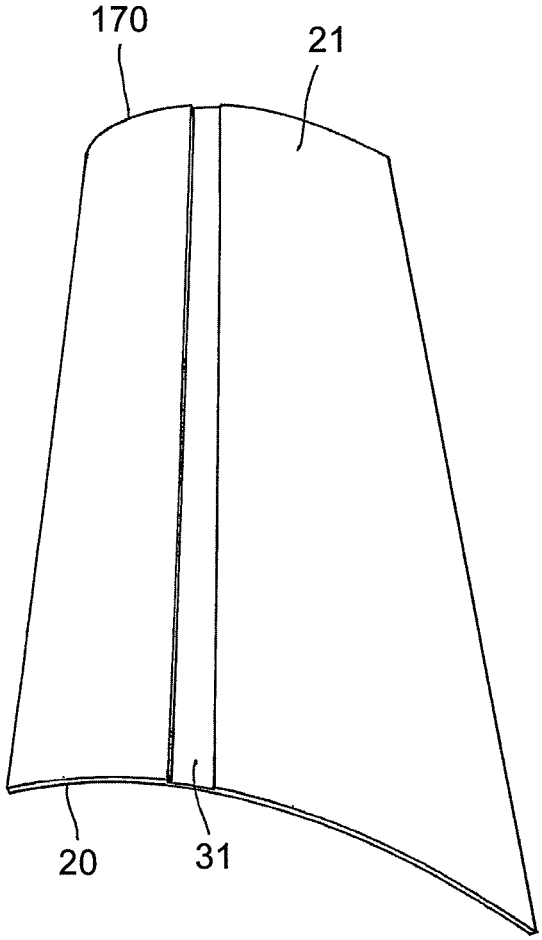
FIG. 14 is a perspective view illustrating Sixth Embodiment of a turbine vane of a steam turbine according to the invention when viewed in a base from a tip of a face side member.

FIG. 14 illustrates Sixth Embodiment of a turbine vane of a steam turbine according to the invention. Hereinafter, the turbine vane of the steam turbine of Sixth Embodiment will be described. In the drawings, the same reference signs of FIGS. 1 to 13 indicate the same components.

In the turbine vane 7 of the steam turbine of First, Second, Third, Fourth, and Fifth Embodiments, the plate spring members 19 to 196 are positioned to the inner surface 21 of the face side member 170 by the welding portion 30. On the contrary, in the turbine vane 7 of the steam turbine of Sixth Embodiment, the structure for positioning the positioning portion 27 of the plate spring members 19 to 196 and the inner surface 21 of the face side member 170 is formed as an uneven fitting positioning structure. That is, a positioning recess 31 is provided at a position in which the positioning portion 27 of the plate spring members 19 to 196 is positioned in the inner surface 21 of the face side member 170. Further, the positioning portion 27 of the plate spring members 19 to 196 is formed as a positioning convex portion. When the positioning portion 27 as the positioning convex portion of the plate spring members 19 to 196 is fitted to the positioning recess 31 of the inner surface 21 of the face side member 170, the relative position between the plate spring members 19 to 196 and the face side member 170 may be determined. Here, when assembling the plate spring members 19 to 196, the face side member 170, and the back side member 18 (the vane members), the plate spring members 19 to 196 are nipped between the face side member 170 and the back side member 18 while being elastically deformed, so that there is no need to worry the positional deviation of the plate spring members 19 to 196 with respect to the face side member 170 and the back side member 18.

Since the turbine vane 7 of the steam turbine of Sixth Embodiment has the above-described configuration, the substantially same operation and effect as those of the turbine vane 7 of the steam turbine of First, Second, Third, Fourth, and Fifth Embodiments may be achieved.

Particularly, in the turbine vane 7 of the steam turbine of Sixth Embodiment, the welding operation is not performed. For this reason, the welding strain is not generated. Accordingly, the elastic contact area between the elastic contact portion 28 of each of the plate spring members 19 to 196 and the inner surface 22 of the back side member 18 may be widened, and hence the self-excited vibration generated in the turbine vane 7 may be further reliably suppressed.

In addition, in the turbine vane 7 of the steam turbine of Sixth Embodiment, the welding operation is not performed, so that the assembling process may be shortened and the manufacturing cost may be decreased.

"Description of Examples Other than First, Second, Third, Fourth, Fifth, and Sixth Embodiments"

Furthermore, in First to Sixth Embodiments, the elastic contact portion 28 of each of the plate spring members 19 to 196 elastically contacts the inner surface 22 of the back side member 18. Incidentally, in the invention, the elastic contact portion of the plate spring member may elastically contact the inner surface of the face side member or the elastic contact portion of the plate spring member may elastically contact both the inner surface of the face side member and the inner surface of the back side member.

REFERENCE SIGNS LIST

1 STEAM TURBINE
2 STEAM GENERATOR
3 HIGH-PRESSURE STEAM TURBINE
4 MOISTURE SEPARATOR HEATER
5 CASING
6 ROTOR SHAFT
7 TURBINE VANE
8 TURBINE BLADE
9 STEAM INLET
10 STEAM PASSAGE
11 SHROUD
12 BLADE ROOT RING
13 WELDING PORTION
14 SPACE
15 SLIT
16 OPENING
17, 170 FACE SIDE MEMBER (VANE MEMBER)
18 BACK SIDE MEMBER (VANE MEMBER)
19, 190, 191, 192, 193, 194, 195, 196 PLATE SPRING MEMBER
20 FACE SURFACE
21 INNER SURFACE
22 INNER SURFACE
23 BACK SURFACE
24 LEADING EDGE
25 TRAILING EDGE
26 WELDING PORTION
27 POSITIONING PORTION
28 ELASTIC CONTACT PORTION
29 CONNECTION PORTION
30 WELDING PORTION (POSITIONING PORTION)
31 POSITIONING RECESS
32 GROOVE
33 GROOVE
A CIRCUMFERENTIAL DIRECTION OF ROTOR SHAFT
B AXIAL DIRECTION OF ROTOR SHAFT
C RADIAL DIRECTION OF ROTOR SHAFT
D WATER INFLOW DIRECTION
E WATER OUTFLOW DIRECTION

The invention claimed is:

1. A turbine vane of a steam turbine comprising:
a vane member that has a space formed therein; and
a plate spring member that is disposed inside the space of the vane member and elastically contacts an inner surface of the vane member, wherein:
the plate spring member includes a positioning portion which is positioned in the inner surface of the vane member, an elastic contact portion which elastically contacts the inner surface of the vane member, and a connection portion which connects the positioning portion to the elastic contact portion,
the elastic contact portion is divided into a plurality of segments in a length direction of the vane member, and
the elastic contact portion of the plate spring member is an area in which the elastic contact portion elastically contacts the inner surface of the vane member, and the elastic contact area of the elastic contact portion at a center in the length direction of the vane member is wider than the elastic contact area of the elastic contact portion at both ends in the length direction of the vane member.

2. The turbine vane of the steam turbine according to claim 1,
wherein the plate spring member is formed as one piece.

3. The turbine vane of the steam turbine according to claim 1,
wherein the plate spring member is formed of a plurality of pieces in the length direction of the vane member.

4. The turbine vane of the steam turbine according to claim 1,
wherein the elastic contact portion of the plate spring member elastically contacts the inner surface of a back surface of the vane member.

5. The turbine vane of the steam turbine according to claim 1,
wherein a structure for positioning the inner surface of the vane member and the positioning portion of the plate spring member is formed as an uneven fitting positioning structure.

6. A steam turbine comprising a plurality of turbine vanes according to claim 1 arranged in a circumferential direction of a rotor shaft.

* * * * *